US005855022A

United States Patent [19]

Storto

[11] Patent Number: 5,855,022

[45] Date of Patent: Jan. 5, 1999

[54] GOLF GLOVE AND METHOD OF MAKING SAME

[76] Inventor: Robert D. Storto, 200 S. Waters Edge, Glendale Heights, Ill. 60139

[21] Appl. No.: 60,564

[22] Filed: Apr. 14, 1998

[51] Int. Cl.[6] ..... A41D 19/00

[52] U.S. Cl. ..... 2/161.2; 473/205

[58] Field of Search ..... 2/20, 159, 160, 2/161.1, 161.2, 161.3, 161.4, 168, 169; 473/205

[56] References Cited

U.S. PATENT DOCUMENTS

| | | | |
|---|---|---|---|
| 2,456,678 | 12/1948 | Cole | 2/159 |
| 3,532,344 | 10/1970 | Masstab | 2/160 |
| 3,848,874 | 11/1974 | Elkins, Jr. . | |
| 3,863,271 | 2/1975 | Morony . | |
| 4,329,741 | 5/1982 | Bach | 2/161.2 |
| 4,962,547 | 10/1990 | Minnick . | |
| 5,184,353 | 2/1993 | Goldwitz | 2/161 |
| 5,253,367 | 10/1993 | Lappley . | |
| 5,542,126 | 8/1996 | Harvanek | 2/161.1 |

*Primary Examiner*—Michael A. Neas
*Assistant Examiner*—Gary L. Welch
*Attorney, Agent, or Firm*—Meroni & Meroni

[57] ABSTRACT

An improved golf glove that encourages the proper placement of the golf club in the user's hand and enhances grip while providing a visual means of placement of the user's hand relative to the golf club to allow selection of different strokes. A novel pad which employs multiple layers and a tapered profile is located in the palm of the golf glove to ensure proper club placement over the knuckles of the hand and an enhanced grip. A graduated set of circular indicia are strategically aligned on the dorsal surface of the glove to allow the user to visually determine when the hand is in the desired grip by aligning the appropriate indicia over the shaft of the golf club; alignment over the largest circle ensures a "strong" grip, alignment over the smallest circle ensures a "neutral" grip.

20 Claims, 6 Drawing Sheets

GOLF GLOVE AND METHOD OF MAKING SAME

BACKGROUND OF THE INVENTION

It is well known that a proper grip is essential to success in golf. The golf glove of this invention addresses two aspects of golf grip. The first aspect of grip which is addressed is directed to holding the golf club in the proper position in the hand. That is, the golf club should lie across the base of the fingers rather than in the palm of the hand. Although the golf club may be placed in correct position initially, the golfer may inadvertently reposition the golf club to the palm of the hand during prolonged use. The second aspect of grip which is addressed by this invention is directed to the alignment of the hand relative to the shaft of the golf club. By consistently achieving the same alignment the golfer will achieve consistency in his golf game. By adjustment of this alignment, the golfer enhances his golf game by adding a selection of shots to his repertoire.

Therefore, it is a principle object of this invention to provide a golf glove which assures correct placement of the golf club over the base of the fingers by means of a visual target on the palmar surface of the glove. The visual target is in the form of groups of small ventilation perforations in the glove fabric, placed strategically over the base of the fingers in the precise location the golf club handle should be placed for correct grip.

Another object of this invention is to provide a novel multilayered pad in the palmar surface of the glove to promote and maintain the correct placement of the golf club handle within the hand.

Another object of this invention is to provide a set of indicia strategically placed on the dorsal surface of the glove which allows the golfer to selectively align his hand over the shaft and insures a consistent grip.

Golf gloves to aid in the gripping of golf club handles have been disclosed in the prior art. U.S. Pat. Nos. 3,863,271, 4,329,741, and 5,253,367 disclose golf gloves having padding in the palm of the glove to aid in positioning and improve hand grip strength. However, none of these gloves employed a palmar pad having multilayered construction to improve comfort and performance. U.S. Pat. Nos. 3,848,874, 4,962,547, and 5,184,353 describe the use of indicia to visually determine and consistently position the hands from one golf shot to another but do not disclose means to allow the user to adjust his grip consistently so as to select a hook, neutral, or slicing shot.

SUMMARY OF THE INVENTION

The golf glove of this invention is designed to help the golfer play better golf by allowing him to achieve and maintain a proper grip. This glove will allow the unskilled golfer to form and keep good habits, and the skilled golfer will benefit by easily maintaining the proper grip. The improvements found in this invention lie in the use of a novel pad in the palm area of the glove and in the use of indicia on the dorsal side of the glove.

The golf glove of this invention uses markings on the fingers of the glove to insure proper placement of the club within the hand. The correct placement is then reinforced and maintained by employing a pad in the palm of the hand. Palmar pads are well known in the golf glove art, but the novel construction and materials used in the inventive pad provide greatly improved comfort and reduce glove wear. The pad construction employs multiple layers of cushioning material assembled so as to create a tapered profile. This construction maintains the proper grip in a comfortable manner.

Perforations are conventionally used in golf gloves to provide ventilation and improved gripping action. This invention also uses perforations strategically placed on the palmar side of the glove to provide a visual target for placement of the golf club in the fingers. Specifically, a set of perforations overlies the base of the index finger of the user and sets of perforations on subsequent fingers are angled such that they are placed more proximally on the finger, straddling the skin crease between the palm and fingers of the user. The set of perforations on the fourth finger is larger to reflect the tapered diameter of the golf club handle. The golfer places the shaft of the golf club over the perforations on the fingers, and then closes his fingers about the golf club, insuring correct placement of the golf club over the knuckles rather than in the palm of the hand.

The golf glove of this invention is also designed to help the golfer select a desired alignment of the hand relative to the shaft of the golf club in a consistent manner, and allow the golfer to adjust his grip in a consistently reproducible manner. This is accomplished by placing strategically located indicia on the dorsal surface of the glove. In the preferred embodiment the indicia are made up of a group of four circular dots, linearly aligned over the base of the thumb. In use, the golfer aligns the selected dot over the shaft of the golf club. By using the smallest dot, the golfer can choose a neutral grip. If a strong grip is preferred, the golfer can align the largest dot over the shaft of the golf club. Choosing intermediate sized dots allow for a slightly strong and medium strong grip, respectively. Thus, the golfer can choose a desired grip accurately and repeatably, resulting in a consistent golf game. Additionally, the golfer can add new shots to his repertoire by varying his grip using a different indicia.

A golf glove having a glove portion, the glove portion having a palmar side, a dorsal side, a lateral edge, and a medial edge, the glove portion further having a palm area, fingers and thumb, the glove portion further having an inside which contacts the skin of the user, and an outside which contacts the shaft of the golf club, the glove portion having sighting means located on a top outer face of the glove portion in an area between a persons first metacarpal bone and a second metacarpal bone when a hand is engaged in the golf glove comprising a group of markings on the dorsal side of the glove, the group of markings comprising a linear arrangement of dots, said dots placed on dorsal side of glove so that one dot is most proximal and lies over the proximal head of the first metacarpal bone of the user's hand, and another of the dots lies over the shaft of the second metacarpal bone of the user's hand just proximal of the distal head of this bone, the dots being selectively alignable with a longitudinal center line axis of a golf club by rotative hand movements enabling the user's gloved hand grip on the golf club to be varied in adjustable positions by aligning a pre-selected dot to be aligned with the longitudinal center line axis of a golf club to allow a user to impart different spins to a golf ball when hit to produce a pre-selected type of trajectory to a golf ball when hit by the golf club when swung by the user.

DESCRIPTION OF THE PREFERRED EMBODIMENT

Figure 1:
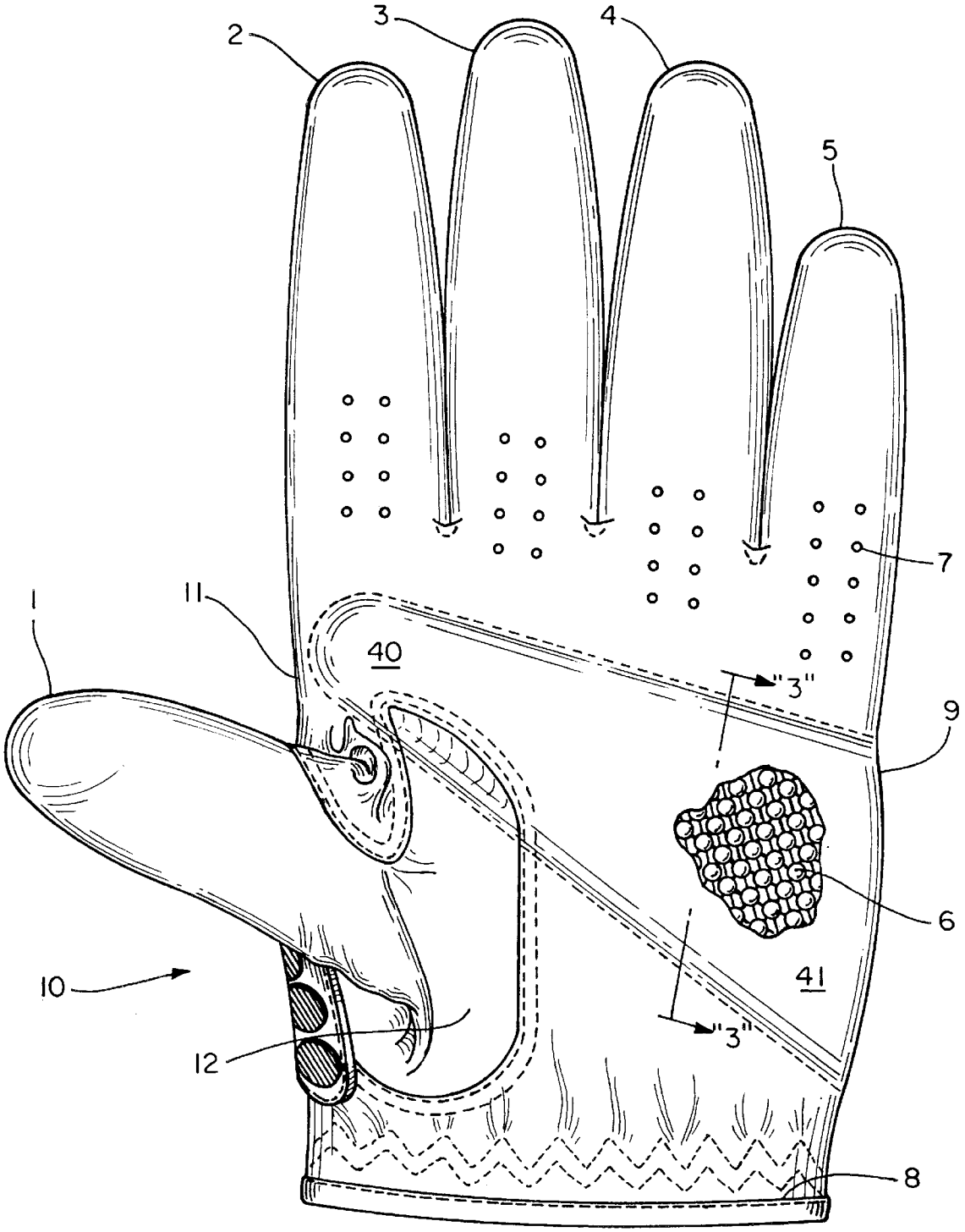
FIG. 1 is a plan view of the palmar side of the golf glove showing the position of the layered pad and palmar perforations.
Figure 2:
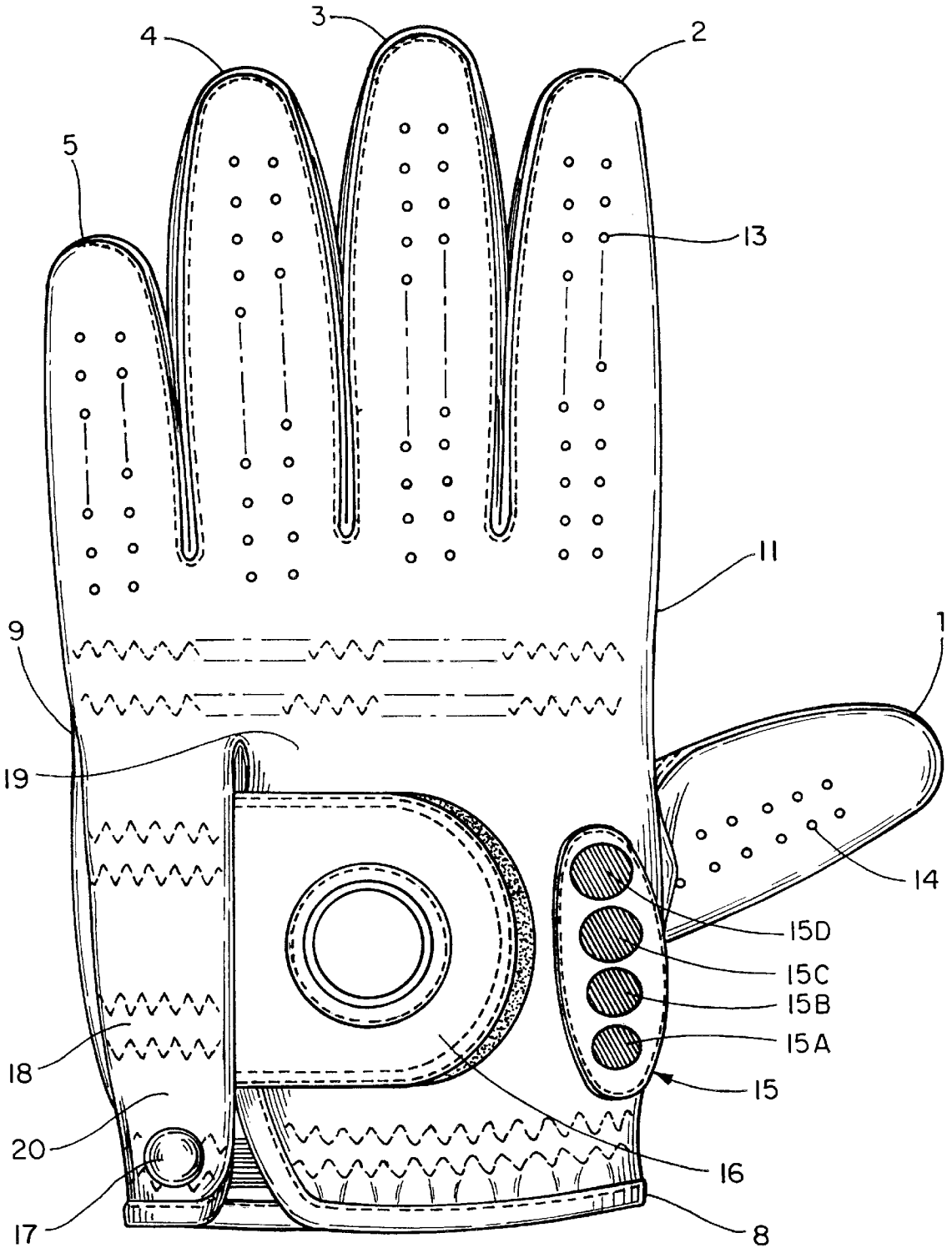
FIG. 2 is a plan view of the dorsal side of the golf glove showing the placement of the indicia.

The golf glove 10 of the present invention is shown in FIGS. 1 and 2. The golf glove described herein is for a right handed golfer, with the golf glove worn on the left hand of the golfer. It is to be understood that a similar glove could be made for the right hand of a left handed golfer, that glove having the appearance of a mirror image of the glove shown in the drawings. Golf glove 10 includes a glove portion that is substantially conventional and consists of a palmar side (FIG. 1) and a dorsal side (FIG. 2). Both palmar and dorsal sides include wrist area 20, thumb 1, and first, second, third, and fourth fingers 2, 3, 4, and 5, respectively. Golf glove 10 further includes a lateral edge 11, medial edge 9, an inside which contacts the skin of the user and an outside which contacts the shaft of the golf club. The preferred embodiment includes a proximal elastic band 8 in the wrist area 20 which insures good fit of the glove about the wrist of the golfer.

Referring to the palmar side in FIG. 1, a multilayered pad 6 is formed on the palm area 12 of the glove. The preferred embodiment is generally triangular in shape, but other elongate multi-sided shapes could be used. The multilayered pad 6 is positioned on the inside surface of the palmar area 12 so that when the golf glove is worn on the human hand, the apex 40 of the triangle rests over the distal head of the metacarpal bone of the first finger at the lateral edge 11 of the glove, and the base 41 of the triangle extends along the shaft of the metacarpal bone of the fourth finger and the carpal bones at the medial edge 9 of the glove.

Figure 3:
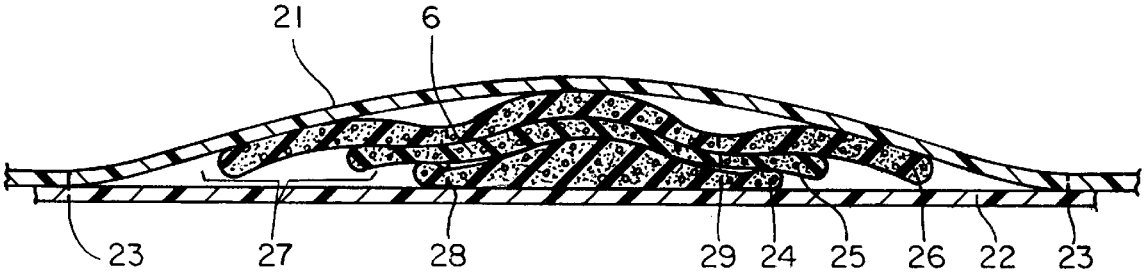
FIG. 3 is a sectional view of the layered pad taken along line 3—3 in FIG. 1.

The multilayered pad 6 is comprised of three layers 24, 25, and 26, of padding material, each layer having the same shape but being graduated in size. FIG. 3 shows a sectional view of the multilayered pad 6 within the golf glove.

The multilayered pad 6 is attached to the inside of the golf glove by placement within a pocket formed by sewing (note seam 23) a lining 22 to the inside surface of the palmar area 12 of the glove. The multilayered pad 6 lies freely within the pocket and is only fixed to the glove at the medial edge 9 where it is sewn into the medial seam. This construction allows the pad some adjustment to the hand of the user.

The multilayered pad 6 is oriented within the glove such that the smallest layer 24 lies adjacent to the lining 22, and the largest layer 26 lies adjacent the inside of the palmar area of the glove. Further, the layers are stacked such that the centers of each layer overlie each other, FIG. 3. The layers are fastened to each other in such a way so as to maintain the stacked conformation described above while allowing the layers to shift slightly relative to each other. This fastening is achieved by sewing two parallel seams 28, 29 within the perimeter of the smallest pad 24. Although sewing is used in the preferred embodiment, other fastening means such as localized heat application, gluing, etc., are within the scope of this invention. This novel multilayered construction provides a more flexible pad than a single layered pad, thus improving function and comfort to the user.

The use of graduated layers provides a pad having a tapered edge 27, FIG. 3. The tapered edge 27 of the multilayered pad 6 provides a wedging surface to securely contact the shaft of the golf club. The multilayered pad 6 is positioned on the palm area 12 so that the tapered edge 27 promotes and maintains the proper positioning of the shaft of the golf club over the knuckles of the users hand. Use of a tapered edge 27 also improves golf glove wear by eliminating sharp contact points between the padding material and glove.

Figure 4:
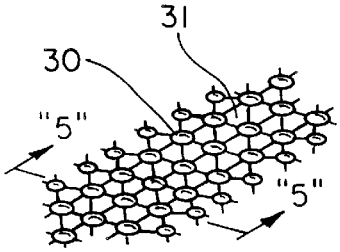
FIG. 4 is a detail view of the top surface of the preferred padding material which shows the foam rubber "bubbles" embedded on a foam rubber mesh.
Figure 5:
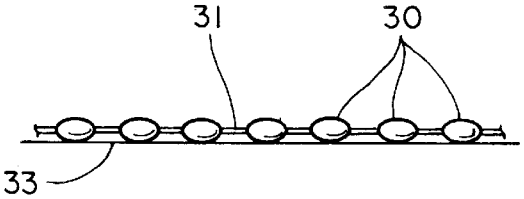
FIG. 5 is a side view of the preferred padding material of FIG. 4 showing a flat bottom surface and bubbled top surface.
Figure 6:
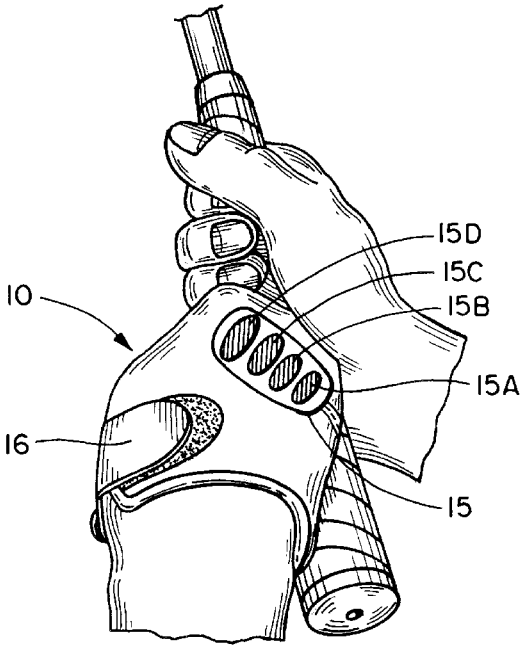
FIG. 6 is a perspective view of the golf glove on the hand of the user depicting the alignment of the largest circular indicia over the shaft of the golf club, showing how the indicia can be used position the left hand over the shaft of the golf club to cause a shot which has a greater tendency to hook from right to left.

The preferred padding material is a foam rubber manufactured by Rubbermaid Corporation and sold as shelf liner. It is comprised of small bubbles (30) of foam rubber embedded in a foam rubber mesh as depicted in FIG. 4, and will be referred to hereafter as bubble-mesh foam rubber (31). An important feature of this material is the substantial open area between the bubbles of synthetic material. Although a bubble-mesh foam rubber is the preferred padding material, use of other materials such as gels, conventional foam rubbers, cotton batting, etc., when used in a layered construction are within the scope of the invention. Referring to FIG. 5, the bubble-mesh foam rubber is fabricated in sheets, the bottom surface 33 being flat and the top surface having a substantially knobbed texture. The layers of padding material are stacked such that the top surface 32 of each layer faces the same way, providing maximum overall pad thickness. There are several advantages to using this material rather than other padding materials. First, the bubble-mesh is springy, resilient, and non compacting. Second, the mesh between bubbles forms open space which allows the pad to breath and make it light in weight. Finally, the material is non-absorbent allowing perspiration to dry from the glove very quickly.

Palmar perforations 7 are included on the base of the fingers 2, 3, 4, and 5, respectively, and are strategically placed so as to direct the golfer in the correct placement of the golf club in the hand. The perforations on the first finger 2 overlie the proximal phalanges bone of the index finger of the golfer. The perforations on the second, third and fourth fingers straddle skin crease between the palm and fingers of the golfer's hand. A slightly larger group of perforations is used on the fourth 5 finger to compensate for the tapered diameter of the golf club handle. In use, the palmar perforations 7 are used for initial correct placement of the golf club within the hand and the multilayered pad 6 is used to reinforce and maintain this correct positioning during play.

Referring to the dorsal side of the golf glove in FIG. 2, perforations 13, 14 for ventilation and decorative purposes are provided in the fingers and thumb, respectively. A second elastic band 18 is located across the dorsal area 19 and a faux snap 17 is located on the wrist area of the glove for improved cosmetic appearance. Hook and loop type fastening means 16 is provided, but can be replaced by buttons, snaps, laces, or other means. A set of indicia sighting means 15 are provided on the dorsal area of the glove. This group of markings is made up of a linear arrangement of four circular dots, the circular dots increasing in size and strategically placed so that the smallest dot 15A is most proximal and lies over the proximal head of the first metacarpal bone of the user's hand, and the largest dot 15D lies over the shaft of the second metacarpal bone of the user's hand just proximal of the distal head of this bone. The set of indicia sighting means 15 consists of an applique upon which the series of four circular dots are embroidered. The dots may be embroidered using side-by-side threads or threads sewn in a roundish shape. The embroidered dots are applied to the applique using thread color which is highly contrasted in color relative to the leather of the glove. The applique is sewn to the dorsal surface of the glove at the strategic location described above.

Figure 7:
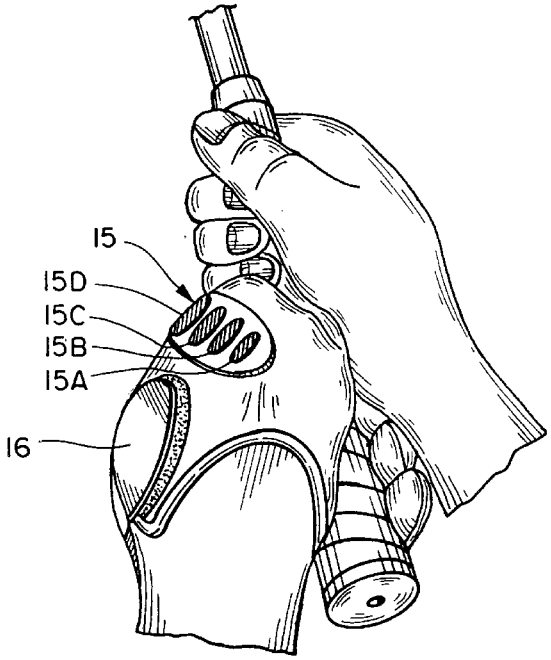
FIG. 7 is a perspective view of the golf glove on the hand of the user depicting the alignment of the smallest circular indicia over the shaft of the golf club, showing how the indicia can be used position the left hand over the shaft of the golf club to cause a shot which has a greater tendency to fade from right to left.
Figure 8:
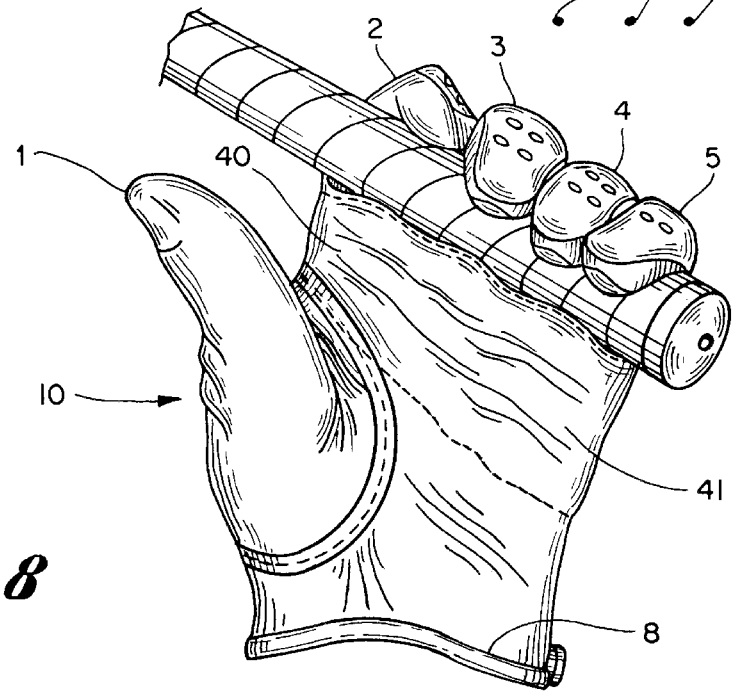
FIG. 8 is a perspective view of the golf glove on the hand of the user showing how the perforations at the base of the fingers on the palmar side of the glove are used to direct the golfer in the correct placement of the shaft of the club in the hand and how the multilayered pad reinforces and maintains that placement.

In use, the golfer aligns the selected indicia over the shaft of the golf club (FIGS. 7 and 8). By using the smallest dot 15A, the golfer can choose a neutral grip. If a strong grip is preferred, the golfer can align the largest dot 15D over the shaft of the golf club. 10 Choosing intermediate sized dots 15B and 15C allow for a slightly strong and medium strong grip, respectively. Thus, the golfer can choose a desired grip accurately and repeatably, resulting in a consistent golf game. Additionally, the golfer can add new shots to his repertoire by varying his grip using a different indicia.

Method of Manufacture

The golf glove is fabricated in a conventional manner such that the top or dorsal side 210 and bottom or palmar side 110 are assembled separately and sewn together as a final step. Each indicia is round with the smallest indicia being closest to the first metacarpal and inserted at the end of the manufacturing process just before the two sides 110, 210 are sewn together. Each of the two sides has an inside surface which contacts the skin of the user and an outside surface which opposes the inside surface. In the case of the palmar side, the outside surface contacts the handle of the golf club.

Figure 9:
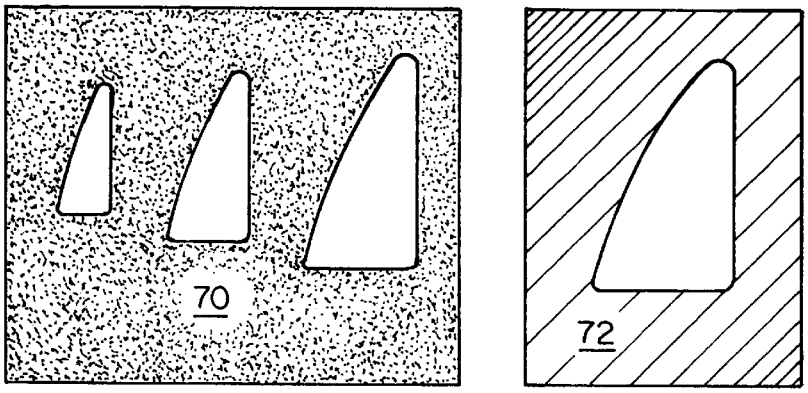
FIG. 9 illustrates Step 1 of the method of manufacture, and shows the templates placed over the fabrication materials.

The inventive method steps are as follows:

Step 1. Referring to FIG. 9, three templates, known as templates A, B, and C, having the same triangular shape but gradually increasing in size are placed over a sheet of padding material 70. The sheet of padding material 70 has a flat surface on one side and a textured surface on the other. A fourth template D, having the same shape as A, B, and C, but being slightly larger in size, is placed over a sheet of lining material 72.

Figure 10:
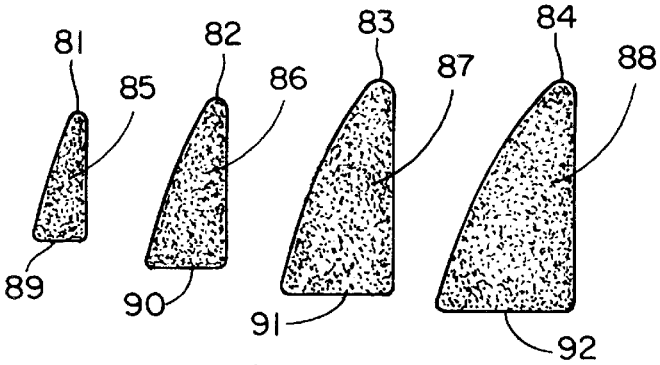
FIG. 10 illustrates Step 2 of the method of manufacture, and shows the noted features of each piece of material.
Figure 11:
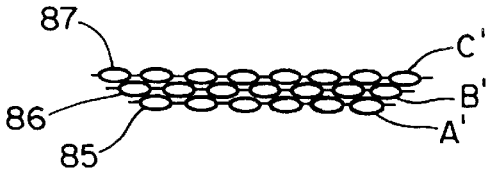
FIG. 11 illustrates Step 3 of the method of manufacture, and shows the stacked relationship of the multiple layers within the pad.

Step 2. Referring to FIG. 10, three pieces of padding A', B', and C' are cut from the sheet of padding material 70 using templates A, B, and C, respectively. A lining D' is cut from the sheet of lining material 72 using template D. Each of the pieces A', B', C' and D' have a center 85, 86, 87, 88, an apex 81, 82, 83, 84, and a base edge 89, 90, 91, 92, respectively.

Step 3. Referring to FIG. 10, the three pieces of padding A', B', and C' are stacked so that the flat surface of each piece faces the same way. Further, the largest piece C' lies on the top with its flat surface upward and the smallest piece A' lies on bottom with its textured surface downward. The centers 85, 86, 87 of each piece are aligned and the base edges 89, 90, 91 are oriented in the same direction so that they generally overlie each other.

Figure 12:
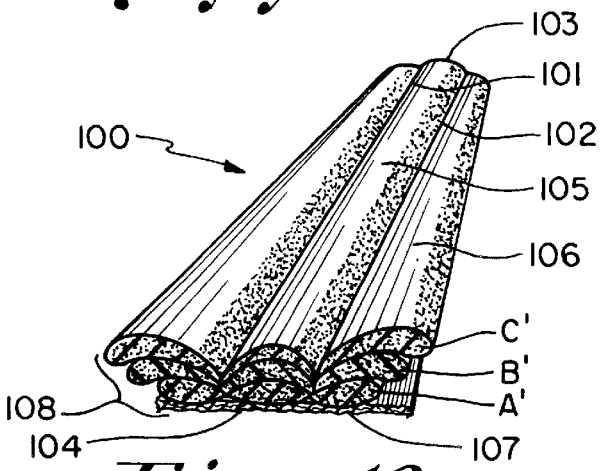
FIG. 12 illustrates Step 4 of the method of manufacture, and shows how the layers of the pad are fastened together.

Step 4. Referring to FIG. 12, a single pad 100 is formed by sewing the three stacked pieces of padding material together using two seams 101, 102 which are roughly parallel and spaced from each other but lie within the edges of the smallest piece A'. Single pad 100 has an apex 103, a center 105, a base edge 104, a flat surface 106, a textured surface 107, and a tapered edge 108.

Figure 13:
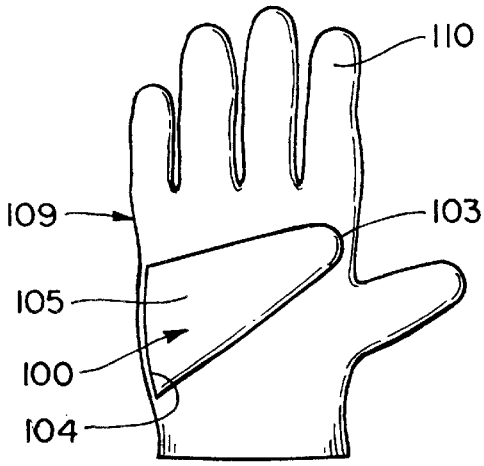
FIG. 13 illustrates Step 5 of the method of manufacture, and shows a view of the inside surface of the palmar side of the glove and placement of the multilayered pad thereon.

Step 5. Referring to FIG. 13, the single pad 100 is placed on the inside surface of the palmar side of the glove 110 such that the flat surface 106 lies in contact with the glove, and the base edge 104 lies along the medial edge 109 of the glove.

Figure 14:
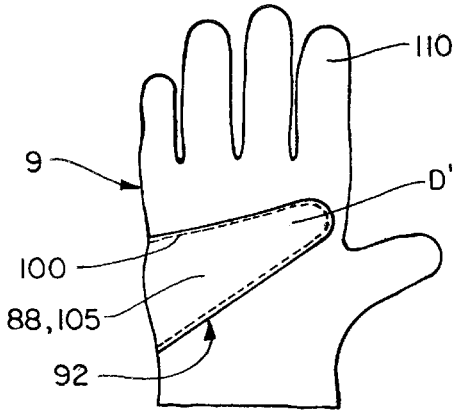
FIG. 14 illustrates Step 6 of the method of manufacture, and shows a view of the inside surface of the palmar side of the glove and placement of the lining over the multilayered pad.

Step 6. Referring to FIG. 14, the lining D' is placed on the inside surface of the palmar side of the glove 110 so as to completely cover the single pad as follows: The center 88 of D' is aligned with the center 105 of the pad and the base edge 92 of D' is oriented so as to overlie the base edge 104 of the pad along the medial edge 9 of the glove.

Figure 15:
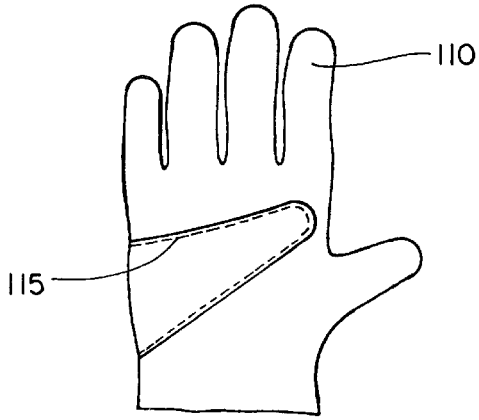
FIG. 15 illustrates Step 7 of the method of manufacture, and shows a view of the inside surface of the palmar side of the glove, detailing the sewing of the lining to the glove to form a pocket about the multilayered pad.

Step 7. Referring to FIG. 15, the lining D' is sewn to the palmar side of the glove 110 by applying a seam 115 along the perimeter of the lining piece so as to form a pocket around pad 100 and so that pad 100 does not intersect seam 115.

Figure 16:
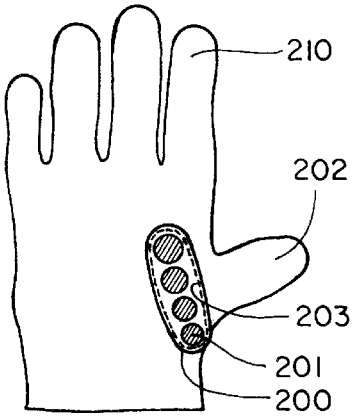
FIG. 16 illustrates Step 8 of the method of manufacture, and shows a view of the outside surface of the dorsal side of the glove and placement of the group of circular indicia.

Step 8. Referring to FIG. 16, an appliqué 200 having a group of circular indicia 201 is sewn to the outside surface of the dorsal side 210 of the glove. The appliqué200 is sewn (seam 203) over the base of the thumb 202 of the glove.

Figure 17:
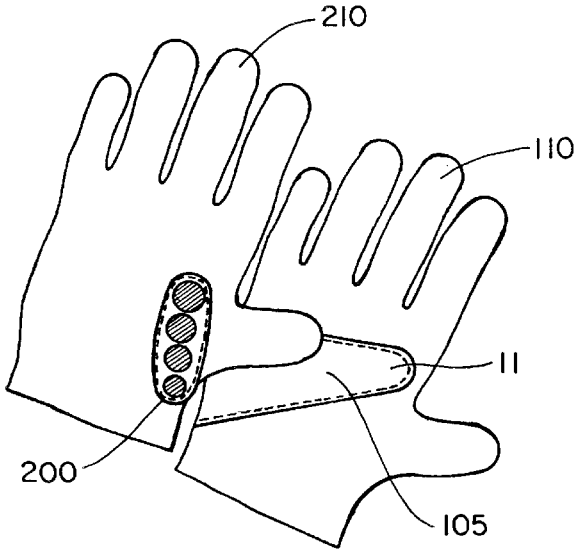
FIG. 17 illustrates Step 9 of the method of manufacture, and gives an exploded view of the final assembly of the golf glove.

Step 9. Referring to FIG. 17, the dorsal 210 and palmar 110 sides of the glove are placed together and sewn together in the usual fashion except that the lining D' and pad 100 are sewn to the glove along the medial seam.

The manufacturing steps recited above refer to the templates A, B, C, and D as triangular. Note that the apex 81, 82, 83, 84 of each template is rounded. This results in a multilayered pad having a rounded apex 103, as well as a smooth curved seam 115, FIG. 12, about the apex 103 in the finished product. Although the preferred embodiment provides for triangular templates, it is within the scope of the invention that other elongate multi sided shapes could be used instead.

The lining material of the preferred embodiment is cut from the same material that is used to form the dorsal and palmar sides of the glove. The preferred glove material is cabretta leather, but substitution of other materials such as cotton, lycra, etc. lie within the scope of this invention.

The padding material of the preferred embodiment is a bubble-mesh foam rubber manufactured by Rubbermaid Corporation and is described in the apparatus section above. However, the substitution of other materials such as cotton batting, gels, etc. lie within the scope of this invention.

I claim:

1. A golf glove having a glove portion and a pad portion, the pad portion comprising a pad and lining, the glove portion having a palmar side, a dorsal side, a lateral edge, and a medial edge, the glove portion further having a palm area, fingers and thumb, the glove portion further having an inside which contacts the skin of the user, and an outside which contacts the shaft of the golf club, the pad comprising multiple layers of cushioning material, each of said layers having the same triangular shape but successive layers gradually decreasing in size so as to form a tapered edge, the pad portion being attached to the glove portion so that when worn on the human hand, the pad portion will lie in the palm area of the glove portion such that the apex of the triangle rests over the distal head of the metacarpal bone of the first finger at the lateral edge of the glove, and the base of the triangle extends along the shaft of the metacarpal bone of the fourth finger and the carpal bones at the medial edge of the glove.

2. The golf glove of claim 1 wherein the cushioning material is comprised of a thin synthetic sheet, said sheet comprising a smooth surface opposite a bubbled surface, said sheet substantially perforated between the bubbles of synthetic material.

3. The golf glove of claim 2 wherein the layers of cushioning material are all oriented the same way relative to the glove portion so that the bubbled surfaces of each layer lie facing the inside of the glove portion.

4. The golf glove of claim 1 wherein the layers are stacked such that the smallest layer rests nearest the inside of the glove portion and the largest layer rests furthest from the inside of the glove portion.

5. The golf glove of claim 4 wherein said layers are fastened to each other along two parallel seams within the perimeter of the smallest layer so as to maintain said stacked conformation while allowing the layers to shift slightly relative to each other.

6. The golf glove of claim 1 wherein the palmar surface of the glove portion is comprised of groups of perforations, said groups of perforations being located across the base of the fingers.

7. The golf glove of claim 6 wherein said groups of perforations are located on the glove portion as follows:

a group of perforations located on the glove portion so as to lie over the proximal phalanges of the first finger of the hand of the user, a group of perforations located on the glove portion so as to lie over the skin crease between the palm and finger of each of the second, third, and fourth fingers of the hand of the user.

8. A golf glove having a glove portion, the glove portion having a palmar side, a dorsal side, a lateral edge, and a medial edge, the glove portion further having a palm area, fingers and thumb, the glove portion further having an inside which contacts the skin of the user, and an outside which contacts the shaft of the golf club, the glove portion further having a group of markings on the dorsal side, the group of markings comprising a linear arrangement of circular dots, said circular dots increasing in size and strategically placed on dorsal side of glove so that the smallest dot is most proximal and lies over the proximal head of the first metacarpal bone of the user's hand, and the largest dot lies over the shaft of the second metacarpal bone of the user's hand just proximal of the distal head of this bone.

9. A golf glove having a glove portion and a pad portion, the pad portion comprising a pad and lining, the glove portion having a palmar side, a dorsal side, a lateral edge, and a medial edge, the glove portion further having a palm area, fingers and thumb, the glove portion further having an inside which contacts the skin of the user, and an outside which contacts the shaft of the golf club, the pad comprising multiple layers of cushioning material, each of said layers having the same triangular shape but successive layers gradually decreasing in size so as to form a tapered edge, the pad portion being attached to the glove portion so that when worn on the human hand, the pad portion will lie in the palm area of the glove portion such that the apex of the triangle rests over the distal head of the metacarpal bone of the first finger at the lateral edge of the glove, and the base of the triangle extends along the shaft of the metacarpal bone of the fourth finger and the carpal bones at the medial edge of the glove, the glove portion further having a group of markings on the dorsal side, the group of markings comprising a linear arrangement of circular dots, said circular dots increasing in size and strategically placed on dorsal side of glove so that the smallest dot is most proxial and lies over the proximal head of the first metacarpal bone of the user's hand, and the largest dot lies over the shaft of the second metacarpal bone of the user's hand just proximal of the distal head of this bone.

10. A method of manufacture for a golf glove, the golf glove having a palmar side, a dorsal side, a lateral edge, and a medial edge, the golf glove further having a palm area, fingers and thumb, the golf glove further having an inside which contacts the skin of the user, and an outside which contacts the shaft of the golf club, such that a golf glove is manufactured in a manner wherein the palmar side and dorsal side are assembled separately and then sewn together, and the following steps are inserted before the dorsal side and palmar side are sewn together:

A. three templates, known as templates A, B, and C, having the same shape but gradually increasing in size are placed over a sheet of padding material, said sheet of padding material having a flat surface and a textured surface, B. three pieces of padding are cut from the sheet of padding material using templates, each of the three pieces having edges and a center, C. the three pieces of padding are stacked so that the flat surface of each piece faces the same way, the largest piece lies on the top with its flat surface upward and the smallest piece lies on bottom with its textured surface downward, and so that centers of each piece are aligned, D. a single pad is formed by sewing the three stacked pieces of padding material together using two parallel seams within the edges of the smallest piece, E. the single pad is placed on the inside surface of the palmar side of the glove such that the flat surface of the largest piece of padding material lies in contact with the glove, and one edge of the single pad lies along the medial edge of the glove, F. a fourth template, known as template D, having the same shape but slightly larger in size than templates A, B, and C, is used to cut a lining piece from a sheet of the same material that is used to form the dorsal and palmar sides of the glove, G. the lining piece is placed on the inside surface of the palmar side of the glove so as to cover the single pad, H. the lining piece is sewn to the palmar side of the glove by applying a seam along the perimeter of the lining piece so as to form a pocket around the single pad and so that the single pad does not intersect said seam, I. an appliqué having a group of circular indicia is sewn to the outside surface of the dorsal side of the glove, J. the dorsal and palmar sides of the glove are placed together and sewn together and the lining piece and the single pad are sewn to the glove along a medial seam of the glove.

11. The method of manufacture of a golf glove of claim 10 wherein said templates A, B, C, and D have a triangular shape.

12. The method of manufacture of a golf glove of claim 10 wherein the appliqué having a group of circular indicia is comprised of four linearly aligned dots having gradually increasing size.

13. The method of manufacture of a golf glove of claim 12 wherein the padding material is Rubbermaid Shelf Liner.

14. The method of manufacture of a golf glove of claim 10 wherein the padding material is comprised of bubbles of foam rubber embedded in a foam rubber mesh.

15. A golf glove having a glove portion, the glove portion having a palmar side, a dorsal side, a lateral edge, and a medial edge, the glove portion further having a palm area, fingers and thumb, the glove portion further having an inside which contacts the skin of the user, and an outside which contacts the shaft of the golf club, the glove portion having sighting means located on a top outer face of the glove portion in an area between a persons first metacarpal bone and a second metacarpal bone when a hand is engaged in the golf glove comprising a group of markings on the dorsal side of the glove, the group of markings comprising a linear arrangement of dots, said dots placed on dorsal side of glove so that one dot is most proximal and lies over the proximal head of the first metacarpal bone of the user's hand, and another of the dots lies over the shaft of the second metacarpal bone of the user's hand just proximal of the distal head of this bone, the dots being selectively alignable with a longitudinal center line axis of a golf club by rotative hand movements enabling the user's gloved hand grip on the golf club to be varied in adjustable positions by aligning a pre-selected dot to be aligned with the longitudinal center line axis of a golf club to allow a user to impart different spins to a golf ball when hit to produce a preselected type of trajectory to a golf ball when hit by the golf club when swung by the user.

16. The golf glove of claim 15 wherein the group of dots each being circular dots, said circular dots increasing in size and strategically placed on dorsal side of glove so that the smallest dot is most proxial and positioned to lie over the proximal head of the first metacarpal bone of the user's hand, and the largest dot being positioned to lie over the shaft of the second metacarpal bone of the user's hand just proximal of the distal head of this bone.

17. The golf glove of claim 15 wherein the linear arrangements of dots are increasing is size and strategically placed on a dorsal side of the glove so that the smallest dot is most proxial and lies over the proximal head of the first metacarpal bone of the user's hand, and the largest dot lies over the shaft of the second metacarpal bone of the user's hand just proximal of the distal head of this bone, the linear arrangement of dots each comprising a series of side-by-side threads sewn to the golf glove.

18. The golf glove of claim 15 wherein an appliqué, means securing said appliqué to an outside surface of the dorsal side of the golf glove, the linear arrangements of dots are increasing in size and strategically placed on a dorsal side of the appliqué so that the smallest dot is most proxial and lies over the proximal head of the first metacarpal bone of the user's hand, and the largest dot lies over the shaft of the second metacarpal bone of the user's hand just proximal of the distal head of this bone.

19. The golf glove of claim 18 wherein the linear arrangement of dots each comprising a series of threads sewn to said appliqué in a roundish shape.

20. The golf glove of claim 15 wherein an applique, stitching securing said appliqué to an outside surface of the dorsal side of the glove, said dots being located on a dorsal side of the appliqué, the linear arrangement of dots each comprising a series of threads sewn to said appliqué.

* * * * *